US009738983B2

(12) United States Patent
King

(10) Patent No.: US 9,738,983 B2
(45) Date of Patent: Aug. 22, 2017

(54) METHOD FOR FABRICATING A DENSE, DIMENSIONALLY STABLE, WETTABLE CATHODE SUBSTRATE IN SITU

(71) Applicant: KCL Enterprises, LLC, Sanibel, FL (US)

(72) Inventor: Harry L. King, Aurora, OH (US)

(73) Assignee: KCL Enterprises, LLC, Sanibel, FL (US)

( * ) Notice: Subject to any disclaimer, the term of this patent is extended or adjusted under 35 U.S.C. 154(b) by 0 days.

(21) Appl. No.: 14/939,362

(22) Filed: Nov. 12, 2015

(65) Prior Publication Data

US 2016/0151839 A1 Jun. 2, 2016

Related U.S. Application Data

(60) Provisional application No. 62/085,856, filed on Dec. 1, 2014.

(51) Int. Cl.

| | |
|---|---|
| ***C25D 17/00*** | (2006.01) |
| ***C25D 17/02*** | (2006.01) |
| ***C25B 9/12*** | (2006.01) |
| ***C25C 7/02*** | (2006.01) |
| ***C25C 3/06*** | (2006.01) |
| ***C25C 3/08*** | (2006.01) |
| ***C22C 1/10*** | (2006.01) |
| *C22C 32/00* | (2006.01) |

(52) U.S. Cl.

CPC ..... *C25C 3/08* (2013.01); *C22C 1/1036* (2013.01); *C22C 32/0073* (2013.01); *C22C 32/0005* (2013.01)

(58) Field of Classification Search

CPC ..... C25D 17/10; C25D 17/12; C25B 9/12; C25C 7/02; C25C 3/06; C25C 3/08

USPC ..... 204/242, 280

See application file for complete search history.

(56) References Cited

U.S. PATENT DOCUMENTS

| | | | |
|---|---|---|---|
| 2,915,442 | A | 12/1959 | Lewis |
| 4,333,813 | A | 6/1982 | Kaplan et al. |
| 4,560,448 | A | 12/1985 | Sane et al. |
| 4,585,618 | A | 4/1986 | Fresnel et al. |
| 4,610,726 | A | 9/1986 | King |
| 5,217,583 | A | 6/1993 | Sekhar et al. |
| 5,961,811 | A | 10/1999 | Keller et al. |
| 6,616,829 | B2 | 9/2003 | Keller et al. |
| 8,501,050 | B2 | 8/2013 | Landwehr et al. |
| 2001/0046605 | A1 | 11/2001 | Huni et al. |

FOREIGN PATENT DOCUMENTS

| | | |
|---|---|---|
| WO | 0029644 | 5/2000 |

OTHER PUBLICATIONS

International Search Report and Written Opinion of the International Searching Authority for PCT/US2015/060594, mailed Mar. 2, 2016.

*Primary Examiner* — Zulmariam Mendez
(74) *Attorney, Agent, or Firm* — Meunier Carlin & Curfman LLC

(57) ABSTRACT

Compositions suitable for use in an electrolytic cell for producing aluminum are provided. The compositions can contain a powder blend of boron oxide, a titanium dioxide, aluminum, and titanium diboride. The powder blend can be compacted into tiles and arranged as a cathode surface. The boron oxide and the titanium dioxide in the tiles can be made to react under low temperature molten aluminum to produce titanium diboride in situ. The reaction yields a dense dimensionally stable wettable cathode substrate that can reduce the power consumption in the aluminum electrowinning process.

7 Claims, No Drawings

METHOD FOR FABRICATING A DENSE, DIMENSIONALLY STABLE, WETTABLE CATHODE SUBSTRATE IN SITU

FIELD OF THE DISCLOSURE

This disclosure relates generally to the production of aluminum by the electrolysis of alumina, more particularly to compositions and methods of fabricating a wettable cathode from powder blends.

BACKGROUND OF THE DISCLOSURE

The aluminum industry generally employs the Hall-Heroult process (U.S. Pat. No. 5,961,811) for producing aluminum. However, carbon cathodes which are traditionally used in the Hall-Heroult cells have the problem that they are not readily wettable with molten aluminum. Thus, conductivity through the surface of the cathode is not uniform but tends to be intermittent. The carbon cathode surface also reacts with the molten aluminum to form aluminum carbide. This reaction depletes the cathode at a rate of 2 to 5 cm/yr for an operating electrolytic cell. This depletion is fostered by the presence of sludge-containing fluoride bath components at the interface between cathode carbon and metal. The presence of aluminum carbide is also detrimental because it results in a high electrical resistivity material which interferes with the efficiency of the cell.

Carbon cathodes also have other problems. The presence of sodium in the electrolytic cell results in the formation of sodium cyanide in the carbon bodies causing disposal problems with the spent potlinings. The Environmental Protection Agency (EPA) has listed spent potlinings as a hazardous material because they contain cyanide.

For at least the reasons discussed above, improved cathodes are needed that are suitable for use in electrolytic cells for producing aluminum. Cathodes that are wettable by aluminum are needed. Economic compositions and methods for fabricating wettable cathodes (in situ) are needed. The compositions and methods disclosed herein address these needs.

SUMMARY OF THE DISCLOSURE

Compositions useful in an electrolytic cell for processing aluminum from alumina are disclosed herein. The compositions can include a powder blend of boron oxide, titanium dioxide, aluminum, and titanium diboride. Methods of making the compositions are provided. In some aspects, the composition can be a powder blend containing a molar excess, with respect to titanium dioxide, of the titanium diboride and/or aluminum. For example, in some aspects, the composition contains 3 molar equivalents of boron oxide, 3 molar equivalents of titanium dioxide, 7 to 21 molar equivalents of titanium diboride, and 20-40 molar equivalents of aluminum. Sintering of the compositions can be initiated using molten aluminum at a low temperature (for example about 700° C.) after pressing into a tile at about 10 KPSI to about 60 KPSI to form a cathode substrate in situ. The reaction of boron oxide, titanium dioxide, and aluminum is exothermic and can be detected by a spike in the aluminum bath temperature. Once the exotherm is detected, this generally indicates formation of the cathode substrate.

The compositions are suitable for use in electrolytic cells for processing aluminum from alumina. In some aspects, the powder blend can be made into dense dimensionally stable and wettable cathodes. The dimensionally stable cathodes can reduce the power consumption in the electrowinning process. The wettable cathode substrate can be used to develop non-carbon bottom cells in a drained cell configuration to eliminate the cyanide problem associated with carbon bottom cells.

The details of one or more embodiments are set forth in the description below. Other features, objects, and advantages will be apparent from the description and the claims.

DESCRIPTION OF THE DISCLOSURE

The present disclosure may be understood more readily by reference to the following detailed description and the examples included therein.

Compositions useful in an electrolytic cell for processing aluminum from alumina are disclosed herein. The compositions can include a powder blend of boron oxide, titanium oxide, aluminum, and titanium diboride. The boron oxide and titanium oxide produce titanium diboride in situ. The amount of titanium dioxide and boron oxide used in the composition can be selected based on the stoichiometric requirements for preparing the titanium diboride in situ. For example, 3 moles of titanium dioxide can be selected along with 3 moles of boron oxide to prepare 3 moles of titanium diboride.

Aluminum is also provided as a reactant in the composition. The aluminum can react with the anionic portion, i.e., the oxide portion in boron oxide and titanium dioxide. The amount of aluminum in the composition can be selected based on the stoichiometric requirements for reacting with the boron oxide and titanium dioxide. For example, the amount of aluminum in the composition can be chosen to react fully with the boron oxide and titanium dioxide in situ. In some aspects, the composition can contain 20-40 molar equivalents of aluminum with 3 molar equivalents of boron oxide, and 3 molar equivalents of titanium dioxide.

The compositions or the powder blends can contain a molar excess of aluminum, such that when the titanium dioxide, boron oxide, and the aluminum react, aluminum is present in the product as shown in the equation below:

$$3TiO_2+3B_2O_3+(7\text{-}21)TiB_2+20\text{-}40Al \rightarrow (10\text{-}24)TiB_2+5Al_2O_3+10\text{-}30Al$$

The aluminum can be present in at least 100 percent molar excess of titanium dioxide. As shown in the above equation, the reaction mixture also contains titanium diboride that is added to the mixture of boron oxide, titanium dioxide, and aluminum (that is not formed in situ by the reaction of the boron oxide and titanium dioxide). At least 7 molar equivalents of added titanium diboride can be added to form a dimensionally stable wettable cathode and up to 21 moles to optimize the physical properties of the cathode substrate. For example, 7 to 21 molar equivalents of the titanium diboride can be present during the reaction of the boron oxide and titanium dioxide. The titanium diboride can be used to provide a dense final product of desirably enhanced dimensional stability plus electroconductivity.

The methods described herein comprise reacting titanium dioxide, boron oxide, aluminum, and optionally titanium diboride to form the additional titanium diboride in situ. The efficiency of the reaction may be increased based on the predetermined reaction conditions. For example, the titanium diboride, aluminum, and the reaction precursors, i.e., boron oxide and titanium dioxide, may be provided in finely divided or powdered form. In particular, smaller particles tend to react more completely and more quickly since a more intimate mixture of the precursor oxides can be obtained. Smaller particles, e.g., 45 μm or less, are particularly desirable.

In another embodiment, titanium dioxide and boron oxide can be intimately mixed together followed by mixing with aluminum. The resulting mixture can be homogenously blended with titanium diboride to form a uniform powder blend. The finely divided reactants, i.e., titanium dioxide, boron oxide, and aluminum, can be blended at room temperature in any suitable manner known to those skilled in powder metallurgy for yielding an intimate, homogeneous blend of reactant particles, such as ball milling or twin shell blending.

The resulting reaction mixture can then be pressed into a tile, by any method known to those of skill in the art. For example, the reaction mixture can be pressed together at ambient temperature and at a pressure of from 10 KPSI to 60 KPSI. The tile can be arranged to form a cathode or cathode surface, which is then covered with molten aluminum (e.g., pourable molten aluminum) at an initial temperature of 700° C. The temperature of the system can be gradually raised until an exothermic spike is detected. The reaction of titanium dioxide, boron oxide, and aluminum to form titanium diboride is exothermic and can be detected by a spike in the aluminum bath temperature. Once the exotherm is detected, this generally indicates formation of the cathode substrate. In some embodiments, no additional heat needs to be added to maintain the reaction. The reaction exotherm can be measured using any suitable method or device for measuring temperature changes. In some embodiments, sintering does not require an inert atmosphere, for example, when carried out under molten aluminum.

The sintered compositions disclosed are dimensionally stable and have improved wettability with molten aluminum and can thereby reduce power consumption in the electrowinning process. As such, the compositions are suitable for use in electrolytic cells for the production of aluminum from alumina, or any cell comprising molten electrolyte. In some aspects, the reaction mixture can be made into tiles which are used to cover the cathode surface in the electrolytic cell. The tiles can be 2 cm to 10 cm thick.

In some embodiments, methods for making a dense dimensionally stable wettable cathode for use in an electrolytic cell for processing aluminum from alumina include, the cathode exhibiting reduced power consumption in the electrowinning process includes blending 3 molar equivalents of boron oxide, 3 molar equivalents of titanium dioxide, and 20-40 molar equivalents of aluminum to form a blend, combining 7 to 21 molar equivalents of titanium diboride with the blend to form a composite, pressing the composite into a tile, and then pouring molten aluminum over the tile to produce the cathode.

The compositions and methods of the appended claims are not limited in scope by the specific compositions and methods described herein, which are intended as illustrations of a few aspects of the claims and any compositions and methods that are functionally equivalent are intended to fall within the scope of the claims. Further, while only certain representative materials and method steps disclosed herein are specifically described, other combinations of the materials and method steps also are intended to fall within the scope of the appended claims, even if not specifically recited. Thus, a combination of steps, elements, components, or constituents may be explicitly mentioned herein; however, other combinations of steps, elements, components, and constituents are included, even though not explicitly stated. The term "comprising" and variations thereof as used herein is used synonymously with the term "including" and variations thereof and are open, non-limiting terms. Although the terms "comprising" and "including" have been used herein to describe various embodiments, the terms "consisting essentially of" and "consisting of" can be used in place of "comprising" and "including" to provide for more specific embodiments and are also disclosed. As used in this disclosure and in the appended claims, the singular forms "a", "an", "the", include plural referents unless the context clearly dictates otherwise.

What is claimed is:

1. An electrolytic cell for processing aluminum from alumina, comprising a dense and dimensionally stable cathode having improved wettability with molten aluminum, the cathode comprising the reaction product of a composition comprising:

3 molar equivalents of boron oxide, 3 molar equivalents of titanium dioxide, 7-21 molar equivalents of titanium diboride; and 20-40 molar equivalents of aluminum, wherein the composition reacts to fully convert the boron oxide and titanium dioxide to titanium diboride in situ in molten aluminum.

2. The electrolytic cell of claim 1, wherein the composition is in the form of a tile or a panel.

3. A method for making a dense dimensionally stable wettable cathode for electrolytic processing of aluminum from alumina, exhibiting reduced power consumption in the electrowinning process comprising:

blending 3 molar equivalents of boron oxide, 3 molar equivalents of titanium dioxide, and 20-40 molar equivalents of aluminum to form a blend, combining 7 to 21 molar equivalents of titanium diboride with the blend to form a composite, pressing the composite into a tile, and heating the tile under molten aluminum from an initial temperature of 700° C. to produce the cathode, wherein the boron oxide and titanium dioxide reacts to fully convert to titanium diboride in situ.

4. The method of claim 3, wherein the boron oxide, the aluminum, the titanium oxide, and the titanium diboride are each provided as particulate materials.

5. The method of claim 4, wherein the particulate materials have an average particle size of 45 μm or less.

6. The method of claim 3, wherein the tile is pressed at room temperature.

7. The method of claim 3, wherein the tile has a thickness from 2 cm to 10 cm.

* * * * *